United States Patent [19]

Munkeso

[11] Patent Number: 5,072,776

[45] Date of Patent: Dec. 17, 1991

[54] PRESS WITH SLIDINGLY SUPPORTED PRESS CHAMBER PARTS FOR PRESSING OF SECTIONS

[75] Inventor: Morten Munkeso, Glostrup, Denmark

[73] Assignee: Dansk Industri Syndikat A/S, Herlev, Denmark

[21] Appl. No.: 545,061

[22] Filed: Jun. 29, 1990

[30] Foreign Application Priority Data

Jul. 6, 1989 [DK] Denmark ..... 3359/89

[51] Int. Cl.[5] ..... B22C 11/10; B22C 15/08

[52] U.S. Cl. ..... 164/207; 164/187

[58] Field of Search ..... 164/207, 187, 182, 227, 164/169, 40, 37

[56] References Cited

U.S. PATENT DOCUMENTS 3,654,986 4/1972 Jansen ..... 164/173

4,030,535 6/1977 Saka ..... 164/207

FOREIGN PATENT DOCUMENTS 54-38221 3/1979 Japan ..... 164/169

*Primary Examiner*—J. Reed Batten, Jr.

*Attorney, Agent, or Firm*—Larson & Taylor

[57] ABSTRACT

A press for pressing mold parts (not shown) for use in an automated foundry plant includes press plates (13,42) slidingly suspended on guides (20,—), which are fastened direct to the press stand (only suggested by 4) independently of the guides (19,31) for the press chambers (7,16). Thus, deformations of the press plate guides, which may be the result of for example an oblique load due to assymmetrical distribution in the mold part in question, are not transmitted to the guides for the press chamber. Therefore, the press chambers are held exactly in position in relation to the press stand, which is essential for obtaining the dimensional accuracy of the finished molds required by the automated foundry plant.

8 Claims, 2 Drawing Sheets

PRESS WITH SLIDINGLY SUPPORTED PRESS CHAMBER PARTS FOR PRESSING OF SECTIONS

The present invention relates to a press for pressing mold parts that includes press plates slidingly suspended on guides which are fastened directly to a press stand and independently of the guides for the press chambers.

Presses of this kind are used increasingly for the production of molds or mold parts for automated foundry plants. With a view to such applications it is essential that the mold parts or molds produced, which are normally composed of two such mold parts to form a mold, display a high degree of dimensional accuracy, failing which would involve a risk of serious malfunctions in the automated foundry plant. In the case of previously known presses of this type it has turned out that the thrust exerted during the pressing operation proper on the press plate or plates is transmitted through the press stand to the press chambers to such a degree that—especially when internally assymmetrical molds are pressed—they may cause the press chambers to assume such an oblique position that the requisite dimensional accuracy of the molds produced cannot be maintained.

The cause of this problem has proved to lie in the fact that the same guides are used for guiding both the press plate or plates and the press chamber or press chambers, and a direct coupling of these parts can be said to take place.

The object of the present invention is to solve the problem mentioned, and to provide an embodiment of a press with which high-precision molds can be made even if the molds display a high degree of internal assymmetry, for example because the mold cavity is substantially deeper at one end of the mold than at the other. This purpose is achieved by a press which, according to the invention, displays the features set forth above. By this very simple, but far-reaching measure, it is an achievement of the present invention that the deformation forces from the press plate or plates will affect only the guides related to the plate or plates, and not the separately mounted guides for the press chamber or chambers. Suitable embodiments of the press according to the invention, and the respective effects are explained in the following description.

Figure 1:
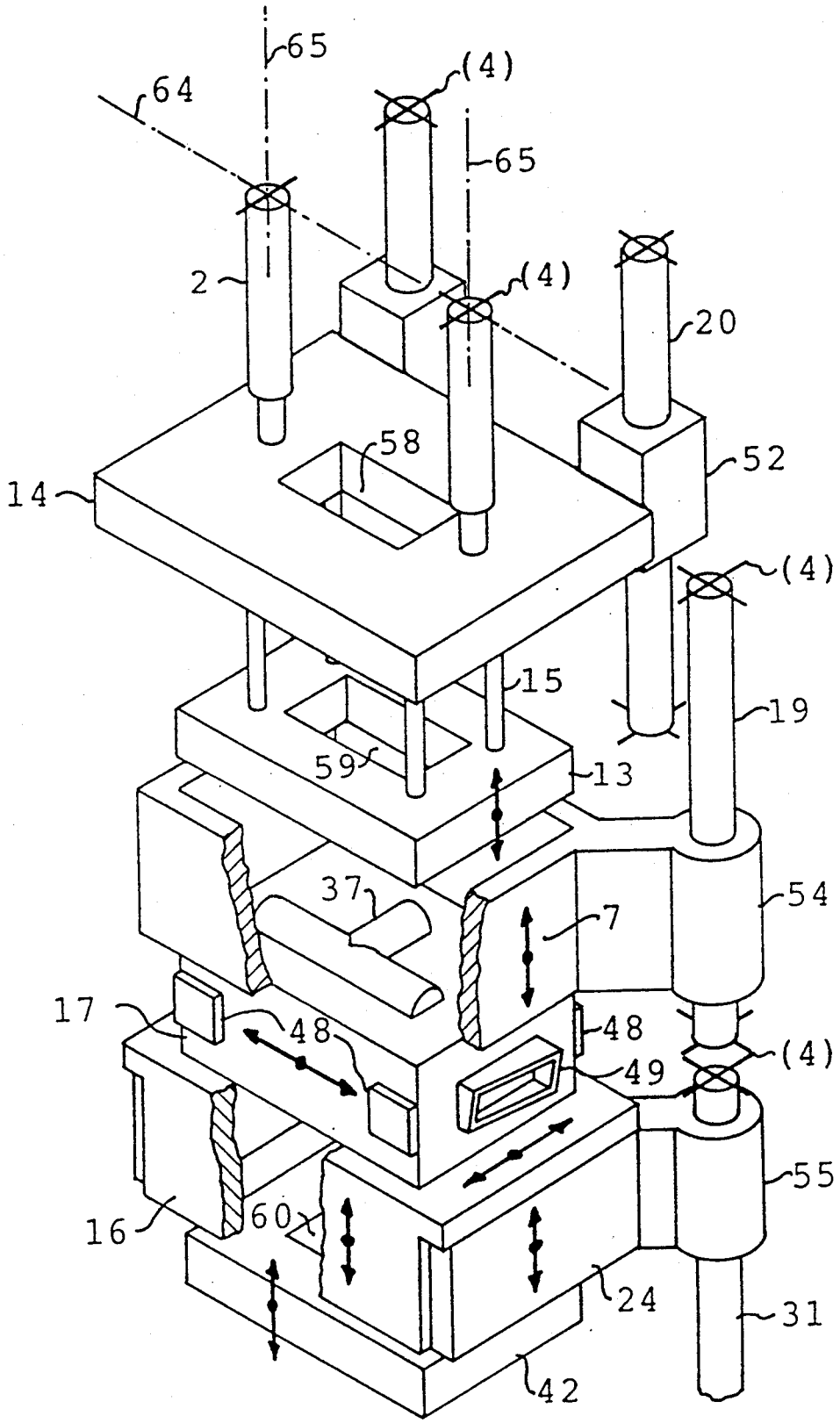
Figures 2, 3:
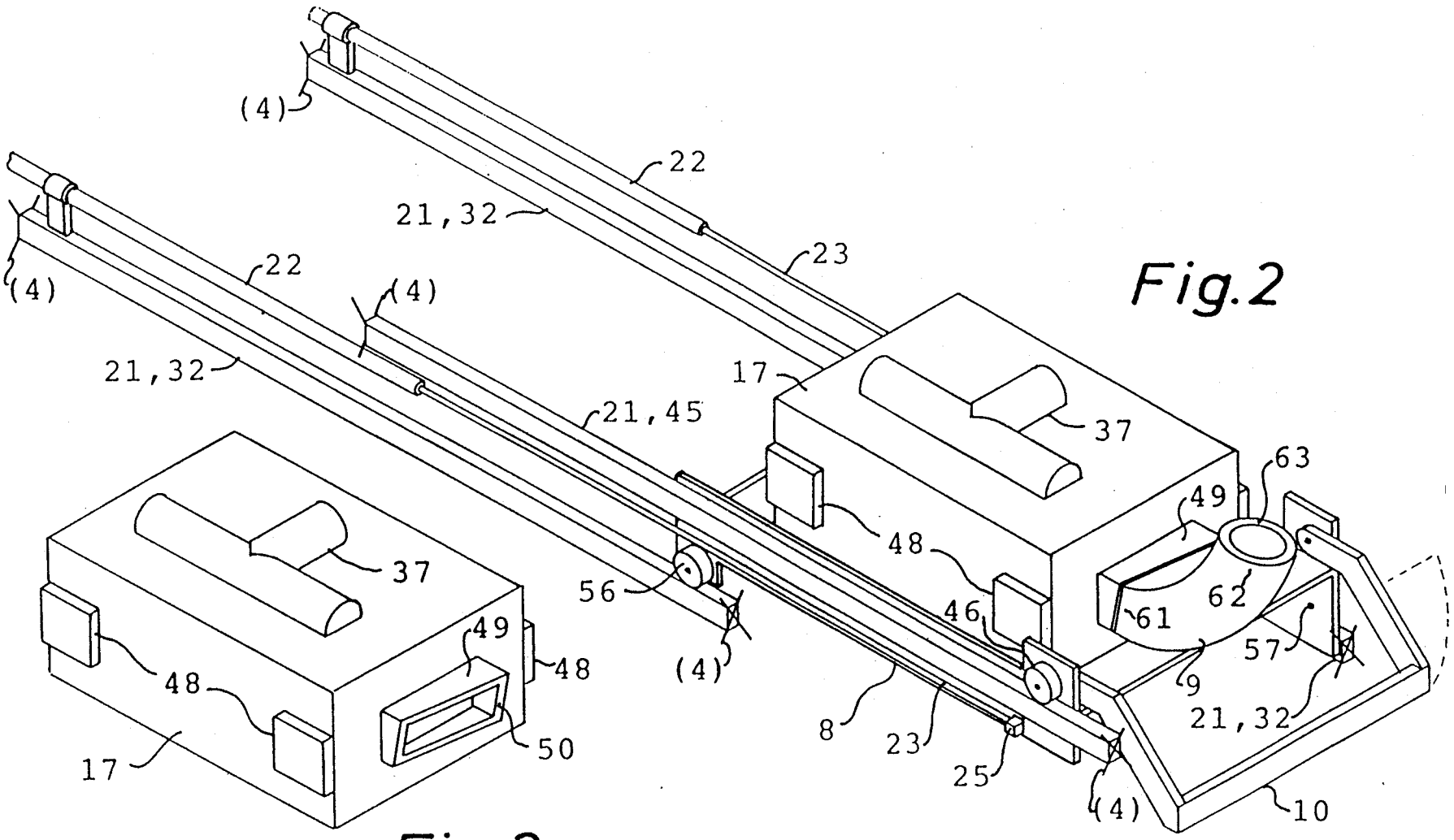

The invention will be explained in more detail in the following with reference to the exemplary embodiments shown in the drawing of the parts of a press according to the invention that are important for the invention, in that FIG. 1 shows the parts that are primarily active during the pressing operation proper, and FIG. 2 shows the means by which the pattern carrier is moved in and out of the press, and FIG. 3 shows the pattern carrier itself.

For the sake of good order it should be noted that the drawing is highly simplified, with a large number of details of the actual press have been left out because they would have made the drawing less clear. It should also be noted that FIGS. 2 and 3 show the parts on a scale which is about one third larger than the scale used in FIG. 1.

The exemplary embodiment of a press according to the invention illustrated in the drawing comprises a stand 4 (not shown in detail in the drawing but sketched by means of a row of crosses), showing that the means in question are fastened to the stand in the places indicated. The stand may be of any suitable type that will absorb the forces occurring during the pressing and the related process stages. Preferably, the stand consists of a relatively sturdy "ridge" which can be imagined in FIG. 1 as placed on the rear side (i.e. the side of the means shown here facing upwards and to the right), as well as means that absorb tensile stresses and which are placed on the front side (i.e. the side which in FIG. 1 faces downwards and to the left). Professionals in this field will know how such a press stand can be designed and built.

The pressing means shown in FIG. 1 are intended for simultaneous pressing of two mold parts, namely an upper mold part (which is formed in an upper press chamber 7 by compression of molding sand between an upper press plate 13 and the top side of a pattern carrier 17, on which for this purpose are placed an upper pattern 37), and a lower press chamber 16 (where the pressing takes place in a similar manner between the lower press plate 42 and the bottom side of the pattern carrier 17, to which a lower pattern (not shown) is fastened).

In the work position of the pattern carrier 17 shown in FIG. 1, the carrier 17 is supported by guide blocks 48, which project from the side of the pattern carrier 17 and engage corresponding, horizontal guides (not shown) in the press stand 4.

The upper press plate 13 is connected to an upper press frame 14 through a number of press plate legs 15, which are relatively thin and therefore transfer only relatively slight lateral forces from the upper press plate 13 to the upper press frame 14.

The upper press frame 14 is disposed horizontally and slides vertically by means of guide slides 52 on a pair of press frame guides 20, which at the ends are fastened to the stand 4. The lower press plate 42 is in a similar manner connected with a lower press frame (not shown), which again is disposed vertically and slides on vertical guides (not shown), which are fastened to the stand 4 in a similar manner as the guides 20.

For the purpose of making it possible to place the pattern carrier 17 with its attached patterns in correct position before each pressing sequence, and to make it possible to remove the upper and lower mold parts (not shown) produced by the pressing, the upper press chamber 7 and the lower press chamber 16 by means of respective guide slides 54, 55, are disposed vertically and slidingly on a set of upper chamber guides 19 and a set of lower chamber guides or auxiliary chamber guides 31, respectively. The chamber guides 19 and 31, of which only a single guide of each set is shown in the drawing, are fastened at the end to the stand 4. It should be noted here that the press frame guides, of which only the upper ones are shown, namely the guides 20, and the chamber guides 19 and 31 are fastened to the stand independently of each other, so that any stresses that one or a set of these guides might be subjected to are not transferred to the others.

In addition, the lower press chamber 16 is in contrast to the upper press chamber 7 adapted to be withdrawn and exchanged or repositioned, as it is disposed horizontally and slidingly on an auxiliary frame 24, which forms the connection to the guide slides 55. The lower press chamber 16 can also be adapted to be moved horizontally by other means, for example by a turret or similar structure. The purpose of the possibility of withdrawing it is only to make it possible to set cores in the top side of the lower mold part, which has been formed by pressing against the bottom side of the pattern carrier 17 and the pattern fastened to it.

Before and possibly during the pressing operation itself, molding sand or other suitable molding material must be supplied to the interior of the press chambers 7 and 16. This may be done for example by means of suitable channel means, which may pass through openings 58,59 and 60 in the upper press frame 14, the upper press plate 13, and the lower press plate 42, respectively, and a corresponding opening in the lower press frame (not shown). The molding sand can be supplied by means of compressed air in the sand tank (not shown) and/or by means of a vacuum, which may be applied for instance to the interior of the press chambers 7 and 16 through openings (not shown) on the top side and the bottom side, respectively of the pattern carrier 17, which openings for this purpose are connected to a vacuum connector 49 whose mode of operation is explained in the following.

During the pressing it is essential that the press chambers 7 and 16 should be placed exactly correct in relation to the pattern carrier 17, as the mold parts formed at the pressing will otherwise be unsuitable for pouring in an automatic foundry plant. However, an oblique thrust load of the press plates 13 and 42 may arise, especially if the patterns used are in some manner assymmetric in relation to the symmetry planes of the press, and this load will of course be transferred to the press frame guides 20 etc., so that these will be deformed corresponding to the oblique load.

Since the press frame guides 20 etc. are fastened directly to the press stand 4 independently of the chamber guides 19 and 31, these deformations will not be transferred to the press chambers 7 and 16, which will therefore be held in position by its related guides 19 and 31 without interference.

In the case of an oblique load of the type mentioned above, a horizontal component in the reactive force on the press plates 13 and 42 may also occur. In order to ensure that this horizontal component (which is transferred to the matching press frames, guide slides and guides) is insignificant, the press plate legs 15 etc. connecting the press plates with the press frames are adapted, dimensioned and positioned in such a manner that in the case of lateral stresses they will yield elastically and cause a transfer of only relatively small lateral forces to the relevant press chamber. However, the legs do not yield significantly in the longitudinal direction, for which reason the side of the mold part facing the press will assume the requisite ion in relation to the concerned side of the pattern carrier 17 and—not least—the matching press chamber.

FIGS. 2 and 3 explain how the pattern carrier 17 can be moved to and from the work position shown in FIG. 1.

The pattern carrier 17 is placed in a detachable manner in a pattern carrier trolley 8, which by means of four wheels (two of which, designated 46 and 56, can be seen in FIG. 2) can roll into and out of the press on a set of rails collectively designated 21. As indicated by a number of crosses the set of rails 21 is fastened in the press stand 4. The pattern carrier trolley 8 can be moved to and from the work position shown in FIG. 1—and incidentally also in FIG. 2—by means of two thrusters 22 whose cylinder part is fastened to the press stand 4 and whose piston rods 23 are fastened to the pattern carrier trolley 8 by means of fastening blocks 25.

By means of precision supporting means (not shown), the pattern carrier 17 is adapted to be detachably mounted in the pattern carrier trolley 8, so that the pattern carrier may be taken out for the purpose of changing patterns, maintenance, or cleaning.

The pattern carrier trolley 8 is adapted as an open frame, so that the pattern carrier 17 can co-operate with the upper press chamber 7 and the upper press plate 13 shown in FIG. 1, not only with its top side and the pattern 37 placed there, but also co-operate with its bottom side and the pattern fastened there with the lower press chamber 16 and the lower press plate 42 also shown in FIG. 1.

On the pattern carrier trolley 8, a vacuum adapter piece 9 is attached. At one of its ends 61, vacuum adapter piece 9 has a coupling face (not visible in FIG. 2) adapted to engage fluid-tight with a coupling face 50, cf. FIG. 3, on the vacuum connector 49 on the pattern carrier 17. At its other end 62, vacuum adapter piece 9 has a coupling face 63 which is adapted to engage fluid-tight with a matching coupling face on a vacuum tube (not shown), which is fastened to the stand 4.

The coupling face 50—and of course also the matching coupling face on the vacuum adapter—is not at right angles to the direction of movement of the pattern carrier 17, but is placed obliquely to this both in the vertical and the horizontal plane. Hereby it is achieved that the fluid-tight engagement between the coupling faces can be ensured without horizontal movement of the pattern carrier 17 in relation to the pattern carrier trolley 8, a fact that is important when the pattern carrier 17 is to be guided on the pattern carrier trolley 8 by means of vertically placed guide pins or similar (not shown). This effect is obviously achieved principally due to the obliqueness in the vertical plane. The obliqueness in the horizontal plane facilitates the introduction of the pattern carrier 17 in a position above its final position on the pattern carrier trolley, when this takes place by means of a turret or similar, on which the pattern carrier is provisionally fastened in a non-radial direction.

After pressing the two mold parts in the upper press chamber 7 and the lower press chamber 16, the press chambers are moved from each other while taking along the mold parts. Whereupon the pattern carrier 17 is by means of the pattern carrier trolley 8 moved to a position (not shown) outside the pressing means by means of the thrusters 22. Then the two mold parts are moved together, possibly after cores have been set, for forming a mold, which is then to be moved out of the press to a pouring station (not shown).

In order to allow the pattern carrier trolley to push the produced mold out of the press onto a suitable table or similar (not shown), the trolley is at the end (shown to the right in FIG. 2) equipped with a pusher 10. In the lowered position shown in FIG. 2 is placed near the surface level of the said table, so that it can push the mold out from the press with minimum stress on the mold. In order to avoid during the opposite directed movement of the pattern carrier trolley 8 that the pusher 10 should damage the lower mold part just made, and especially "green cores" sticking up from it, the pusher 10 is pivotally suspended on the pattern carrier trolley 8 and adapted by means of a truster or similar (not shown) to be raised from the lowered position shown in FIG. 2. Obviously, the raising and lowering of the pusher 10 will take place automatically in accordance of the movement of the pattern carrier trolley 8.

As it can be seen in FIG. 1, the lower press chamber 16 is slidingly suspended on the auxiliary frame 24, as mentioned above for the purpose of setting cores. During the movements required for this it is important that parts belonging to the press stand 4 should not be in the way of the cores, which may project some distance above the top side of the press chamber 16.

In order to avoid that any part of the set of rails 21, on which the pattern carrier trolley runs should be in the way of these cores, the set of rails 21 is sectioned. These sections include two relatively low-placed rails 32, one of which, shown at the top in FIG. 2, is longer than the other, and a relatively high-placed rail 45. To match this arrangement, the pattern carrier trolley 8 is equipped with a set of relatively low-placed wheels (of which only one 56 is seen, whereas the journal 57 for one of the others can be seen to the right in FIG. 2), and a relatively high-placed wheel 46. The relatively low- and high-placed wheels rolling on the respective low- and high-placed rails, as shown in FIG. 2. To avoid that the pattern carrier trolley 8 standing in the way of the cores mentioned, the part of the trolley 8 supported by the high-placed wheel 46 is raised some distance above the other parts of the trolley.

It will be obvious that the rail set 21 and the wheels 46,56 will be unable to support the forces acting on the pattern carrier 17 during the actual pressing operation. The pattern carrier 17 is therefore provided with a number of guide blocks 48 projecting to the side and adapted to be supported by corresponding horizontal guides (not shown) in the stand 4. During the movement away from and into the work position shown in FIGS. 1 and 2, however, the pattern carrier 17 is only supported by the pattern carrier trolley 8 and the rail set 21. But as in such a situation no pressing force is exerted on the pattern carrier 17, this does not cause any problems.

As it appears from FIG. 1, the guides 20,19 and 31 shown are adapted as round rods or pipes. This is preferable at the moment for production reasons, because it is relatively simple to adapt the requisite sliding surfaces as sectionally circular borings in the guide slides 52,54, respectively 55. However, the effect of the separate guiding of the press plates on one side and the press chamber on the other, and of the separation of the guides in the upper and the lower parts of the press, does not depend on such an adaptation of the guides which may, for example, be also square or dove-tailed in an otherwise known manner.

The exemplary embodiment shown comprises "double-acting" pressing, i.e. simultaneous pressing of an upper part and a lower part for a mold. But the equipment shown and described can also be adapted to "single-acting" pressing, i.e. pressing of only on upper mold part or only one lower mold part.

In the foregoing the pressing operation itself has also been described as mainly mechanical, and the embodiment of the parts shown i FIG. 1 are therefore based on pressing of that type. However, the principles illustrated by means of FIGS. 2 and 3 can also be applied on presses where the pressing is carried out in another manner than the one shown, as it will be known in the foundry technology.

In the example shown in FIG. 1 the pressing power is generated on the press plates 13 and 42 generated by means of the press plate cylinders adapted for that purpose (of which the uppermost, designated with 2, is shown). These press plate cylinders are obviously fastened to the stand 4 (not shown). As mentioned above, the press stand 4 can be adapted with a "ridge" placed behind the guides 20,19 and 31 (i.e. in FIG. 1 above and to the right of these), whereas the stand has at the front of the parts shown a means of transmitting tensile stress, for example a tie rod connecting the upper and lower parts of the stand, preferably through jibs adapted for that purpose. Through suitable dimensioning and positioning of the "ridge", the tie rod and the jibs, it can be achieved that while influenced by the pressing forces and thrust from the mold parts, the stand is not subjected to any significant deflection in the symmetry plane of the press plate, which in FIG. 1 is suggested by the dot-and-dash lines 64 and 65, or other planes containing the direction of pressing. In this manner it is avoided the the thrust absorbed by the stand should deform it in such a manner as to disturb the mutual alignment of the press plates, the press chambers, and the pattern carrier.

I claim:

1. A press for pressing mold parts comprising:

a press stand;

at least one press chamber which is slidingly supported in said press stand and which has bordering walls which run parallel to a sliding direction of motion;

for each said press chamber, an associated press plate which is slidingly supported in the same sliding direction in said press stand, each said press plate having outside area dimensions which correspond in general to inside dimensions of the associated said press chamber in which said press plate is received such that said press plate is movable in the associated said press chamber in the sliding direction of motion;

means for placing a pattern at each said press chamber opposite the associated said press plate;

means for filling mold material into each said press chamber;

means for pressing the mold material filled into each said press chamber between the associated said press plate and pattern, said pressing means including a force generating means for exerting a pressing force between the associated said press plate and said press stand;

for each press chamber, discrete chamber guides attached thereto for slidingly supporting the associated said press chamber in the direction of motion;

for each press plate, discrete press plate guides attached thereto for slidingly supporting the associated said press plate in the direction of motion; and wherein said chamber guides and said press plate guides are fastened independently of each other to said press stand.

2. A press according to claim 1 including respective upper and lower said press chambers, respective associated upper and lower said press plates which are pressed respectively downwardly and upwardly in said respective upper and lower press chambers, respective upper and lower said press plate guides attached to said respective upper and lower press plates and independently to said press stand, and respective upper and lower said chamber guides attached to said respective upper and lower press chambers and independently to said press stand.

3. A press according to claim 1 and further including for each press plate:

a press plate frame which is attached to said press plate guides for slidingly supporting said press frame in said press stand; and press legs which project from a rear side of said press plate and which are adapted, dimensioned and positioned in such a manner that said press legs transfer only relatively slight lateral forces from said press frame to said press plate and said press chamber.

4. A press according to claim 3 wherein said press stand when subjected to the pressing force is relatively deflectionless in the direction of motion; and wherein said press stand includes a vertical symmetry plane, there are a plurality of said force generating means which exert the pressing force, and said force generating means are symmetrically placed in relation to said vertical symmetry plane.

5. A press according to claim 4 wherein said chamber guides and said press plate guides are located to one side of said vertical symmetry plane.

6. A press according to claim 5 wherein said press plate legs are positioned symmetrically with respect to said vertical symmetry plane; and wherein there are a plurality of said force generating means positioned symmetrically with respect to said vertical symmetry plane.

7. A press according to claim 6 including respective upper and lower said press chambers, respective associated upper and lower said press plates which are pressed respectively downwardly and upwardly in said respective upper and lower press chambers, respective upper and lower said press plate guides attached to said respective upper and lower press plates and independently to said press stand, and respective upper and lower said chamber guides attached to said respective upper and lower press chambers and independently to said press stand.

8. A press according to claim 7 wherein said press plate guides and said chamber guides include respective circular rods, and associated guide slides having bores in which associated said rods are received.

* * * * *